United States Patent [19]

Rodney, Jr.

[11] Patent Number: 4,715,139

[45] Date of Patent: Dec. 29, 1987

[54] CLOSED BREECH MUZZLE LOADER AND LOADING TOOL

[76] Inventor: Frederick W. Rodney, Jr., 134 Flagg Rd., Rochester, N.H. 03867

[21] Appl. No.: 21,174

[22] Filed: Mar. 3, 1987

[51] Int. Cl.[4] ..... F41C 11/00

[52] U.S. Cl. ..... 42/51; 42/86

[58] Field of Search ..... 42/51, 86, 16, 69.01, 42/69.02, 69.03

[56] References Cited

U.S. PATENT DOCUMENTS

| | | | |
|---|---|---|---|
| 44,784 | 10/1864 | Colvin | 42/51 |
| 237,357 | 2/1881 | Zundorff | 42/16 |
| 269,152 | 12/1882 | Zundorff | 42/16 |
| 331,792 | 12/1885 | Ingersoll | 42/51 |
| 3,757,447 | 9/1973 | Rowe | 42/51 |

FOREIGN PATENT DOCUMENTS

| | | | |
|---|---|---|---|
| 2355506 | 5/1975 | Fed. Rep. of Germany | 42/51 |

*Primary Examiner*—Charles T. Jordan

*Attorney, Agent, or Firm*—Hayes, Davis & Soloway

[57] ABSTRACT

A breech assembly for a muzzle loader. A breech block is fitted into the gunstock and receives the barrel. The breech block includes a first bulkhead disposed over the barrel breech end and has a first bore with an axis parallel to the barrel axis. The breech block includes a second bulkhead spaced from the first bulkhead creating a space there between. The second bulkhead has a second bore in axial alignment with the first bore and the breech block includes a vertically disposed chimney bore communicating between the bottom of the space and the outside atmosphere. A nipple is disposed in the bore facing the space and has a third bore sized to releasably receive a percussion cap. The nipple has a fourth bore communicating between the bottom of the third bore and the barrel interior. A cylindrical sliding sleeve is disposed within the second bore and is slidable between closed and retracted positions. The sliding sleeve has means in the sidewalls for the passage of gases therethrough from the nipple to the chimney bore when the sliding sleeve is in the closed position. A cylindrical firing pin assembly is disposed within the sliding sleeve and is slidable between closed and retracted positions. The firing pin assembly has an axial fifth bore with a firing pin slidably disposed therein and spring means for biasing it towards the nipple. A trigger assembly holds and releases the firing pin against the force of the spring means.

8 Claims, 14 Drawing Figures

CLOSED BREECH MUZZLE LOADER AND LOADING TOOL

BACKGROUND OF THE INVENTION

The present invention relates to guns of the so-called "muzzle loader" type and, more particularly, to a closed breech assembly therefor comprising, a breech block member adapted to be fitted into a gunstock and to receive the barrel in combination with the gunstock, the breech block member including a first bulkhead disposed over the breech end of the barrel, the first bulkhead having a first bore therein having an axis parallel to the axis of the barrel, the breech block member further including a second bulkhead spaced from the first bulkhead to create a space therebetween, the second bulkhead having a second bore therein in axial alignment with the first bore, the breech block member additionally including a vertically disposed chimney bore communicating between the bottom of the space and the outside atmosphere; a nipple member disposed in the first bore, the nipple member having a third bore therein having an axis parallel to the axis of the barrel and facing into the space, the third bore being sized to releasably receive a percussion cap therein, the nipple member further having a fourth bore therein communicating between the bottom of the third bore and the interior of the barrel at the breech end thereof whereby a percussion cap detonated in the third bore will in turn detonate gunpowder disposed in the barrel; a cylindrical sliding sleeve disposed within the second bore, the sliding sleeve being slidable between a closed position against the first bulkhead to cover the space and the nipple member and a retracted position spaced from the first bulkhead to expose the space and the nipple member, the sliding sleeve having means in the sidewalls thereof for the passage of gases therethrough from the nipple member to the chimney bore when the sliding sleeve is in the closed position; a cylindrical firing pin assembly disposed within the sliding sleeve, the firing pin assembly being slidable between a closed position close adjacent the nipple member and a retracted position spaced from the nipple member to expose the nipple member, the firing pin assembly having an axial fifth bore therethrough and including a firing pin slidably disposed within the fifth bore and spring bias means for urging the firing pin towards the nipple member; and, trigger means disposed in the breech block member for holding the firing pin retracted from the nipple member against the bias force of the spring bias means and for releasing the firing pin to move towards the nipple member from the bias force of the spring bias means.

Muzzle loaders have been around for a long time. Some of the earliest muzzle loaders were to so-called "flintlock muskets" as shown in FIGS. 1 and 2 and generally indicated as 10 therein. The early muzzle loaders 10 comprised an elongated barrel 12 fitted at the breech end 14 to a stock 16. The powder 18 and shot were inserted through the open end 20 of the barrel 12, rammed into place with a ramrod (not shown), and held in place with wadding (also not shown). A priming pan 22 also held a quantity of powder 18 which was ignited by the sparks from a flint 24 striking the priming pan 22 when the trigger 26 was pulled. A small bore 28 communicated between the priming pan 22 and the inside of the barrel 12 containing the primary charge of powder 18. When the powder 18 in the priming pan 22 was ignited, the detonation flashed through the small bore

28 to the primary charge of powder 18 within the barrel 12 causing the muzzle loader 10 to fire. As can be appreciated, there was a certain amount of blowback out of the small bore 28 as the muzzle loader 10 fired—largely in the direction of the face and eyes of the shooter. Moreover, any dampness getting into the priming pan 22 could easily cause misfire.

An improvement to the prior art basic muzzle loader 10 of FIGS. 1 and 2 is indicated as 10' in FIG. 3. In this instance, the priming pan 22 has been replaced by a percussion cap holder 30 into which a percussion cap (not shown) is inserted. The small bore 28 is still present communicating between the interior of the barrel 12 and, in this case, the percussion cap holder 30. When the trigger is pulled, the hammer 32 strikes the percussion cap in the holder 30 causing it to detonate and, in turn, detonate the powder 18 in the barrel 12. While the percussion cap muzzle loader 10' of FIG. 3 was a vast improvement over the "flintlock" design of FIGS. 1 and 2, there was still moisture and blowback problems.

Over the years, there have been various improvements to firearms employing percussion caps for the discharge thereof. Most are designed along the lines of the simplified drawing of FIG. 4. As shown therein, there is a primary member 34 containing a first bore 36 for releasably receiving the percussion cap 38. The first bore 36 communicates with the main bore 40 by means of the passageway 42. Secondary member 44 containing a slidable firing pin 46, or the like, is movable against or away from the percussion cap 38 as indicated by the arrow 48. When in the closed position of FIG. 4 and struck by the hammer 50, the percussion cap 38 detonates the main charge (not shown) in the main bore 40. As indicated, the blowback is directed out the space between the primary and secondary members 34, 44. Moisture, of course, can also enter therethrough. For examples of such devices, reference can be made to U.S. Pat. Nos. 1,747,057 (Driggs, Jr. et al.), 4,227,330 and 4,232,468 (Chapin), 4,222,191 (Lee et al.), 3,780,464 (Anderson), 3,757,447 (Rowe), 29,676 (Davis), 1,544 (Bentley et al.), 11,483 (Knight), and 1,422 (Smith).

Despite the very basic nature of muzzle loaders and the many advances in the firearms art, muzzle loaders still have numerous advocates and many states have separate hunting seasons for the use of muzzle loaders as they do for hunters employing bow and arrow. Thus, there continues to be interest in improving the art. For an interesting approach to the use of percussion caps with a muzzle loader, attention is directed to Davis (4,503,633).

There still exists a need in the muzzle loader art for a muzzle loader which essentially seals the percussion cap at the breech from moisture, and the like, while, at the same time, providing a safe and directed exit for the blowback gases upon firing. Moreover, there still exists a need for a manner of quickly and accurately loading a muzzle loader. Other than the bag charges as employed with large naval guns, as shown in U.S. Pat. No. 3,771,459 (Lohnstein), the archaic nature of the loading art with respect to muzzle loaders is typified by Clarke U.S. Pat. No. (1,565), which issued in 1840.

Wherefore, it is the object of the present invention to provide such improvements to the muzzle loader art.

SUMMARY

The forgoing object has been achieved in the muzzle loader closed breech assembly of the present invention which provides a breech which has a slidable closing in combination with a firing pin assembly wherein when opened to cock the firing pin, the percussion cap holding nipple is exposed for ease of access but when the assembly is closed, the percussion cap is protected from contamination within a closed chamber connected at the bottom by a vertically disposed chimney bore which safety directs blowback gases down and away from the shooter's eyes and face.

In one embodiment, a sliding bolt generally of a type normally employed with rifles is incorporated into the present invention to effect the purpose and object thereof.

In a second embodiment, a rotating/sliding bolt generally of a type also normally employed with rifles is incorporated into the present invention to effect the purpose and object thereof.

To further attain the object described above, a muzzle loading tool for accurately, quickly and repeatedly loading a muzzle loader is also described herein.

DESCRIPTION OF THE PREFERRED EMBODIMENT

In the interest of simplicity and to avoid redundancy, the description of the present invention contained hereinafter is made in conjunction with simplified drawings directed to the novel aspects of the present invention and eliminating or showing symbolically those portions well known to those in the fire arms art. Portions corresponding to prior art as hereinbefore described are labelled with the same numbers as previously employed.

Figure 1:
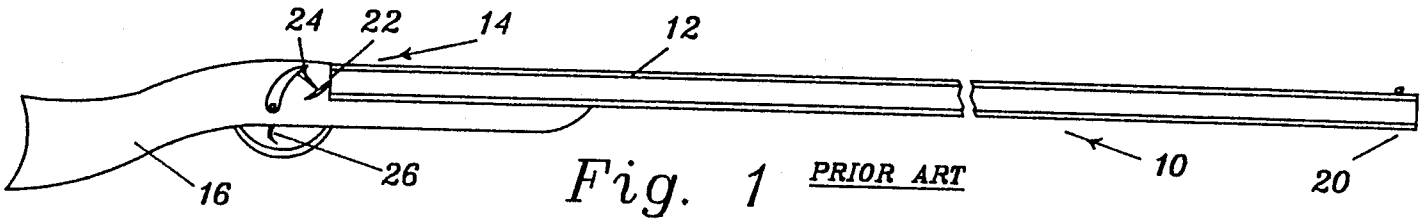
Fig. 1 PRIOR ART
FIG. 1 is a simplified side view of a prior art muzzle loader of the flintlock type.
Figure 2:
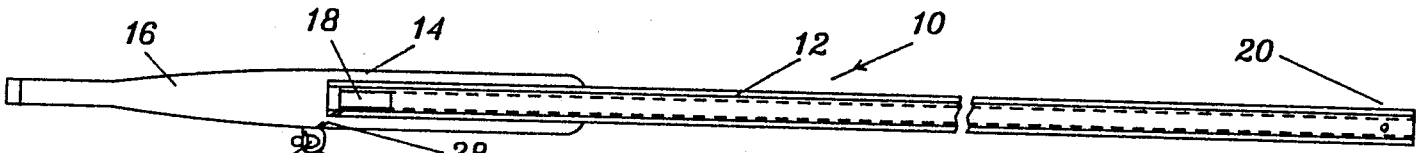
Fig. 2 PRIOR ART
FIG. 2 is a top view of the muzzle loader of FIG. 1.
Figure 3:
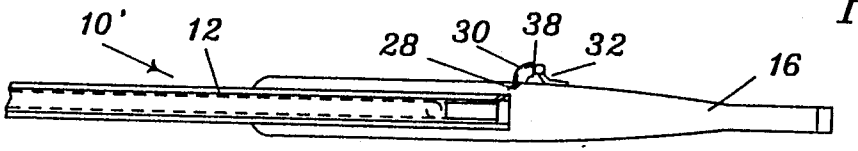
Fig. 3 PRIOR ART
FIG. 3 is a simplified top view of the breech portion of an early prior art muzzle loader of the percussion cap type.
Figure 4:
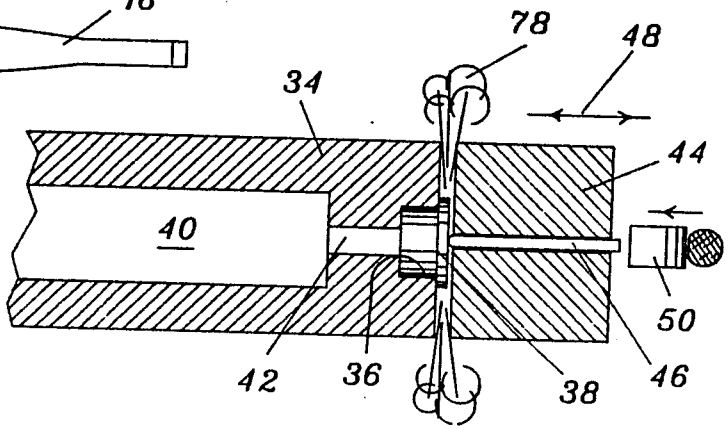
Fig. 4 PRIOR ART
FIG. 4 is a cutaway simplified view of the breech portion of a general prior art approach to later percussion cap detonated muzzle loaders.
Figure 5:
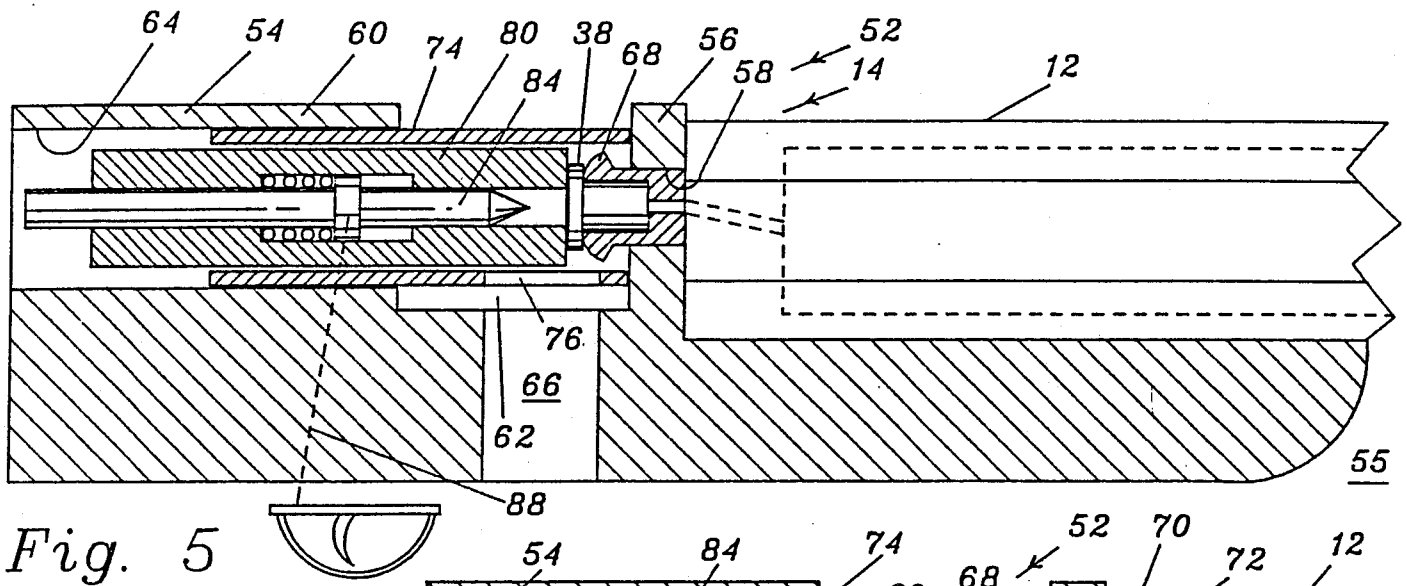
FIG. 5 is a simplified cutaway side view of the breech assembly of the present invention in the closed and cocked position.
Figure 6:
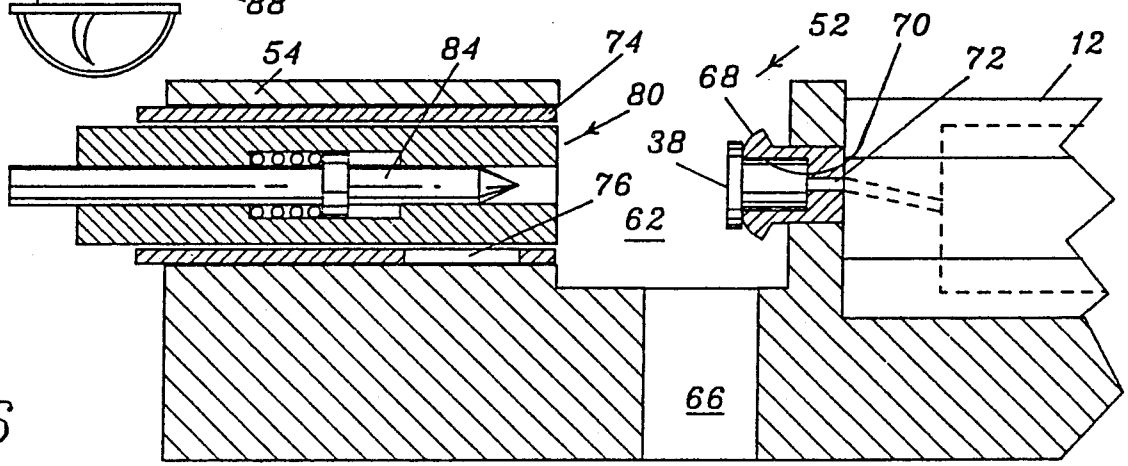
FIG. 6 is a simplified cutaway side view of the breech assembly of FIG. 5 in the open and cocked position.
Figures 7, 8, 9, 10, 11:
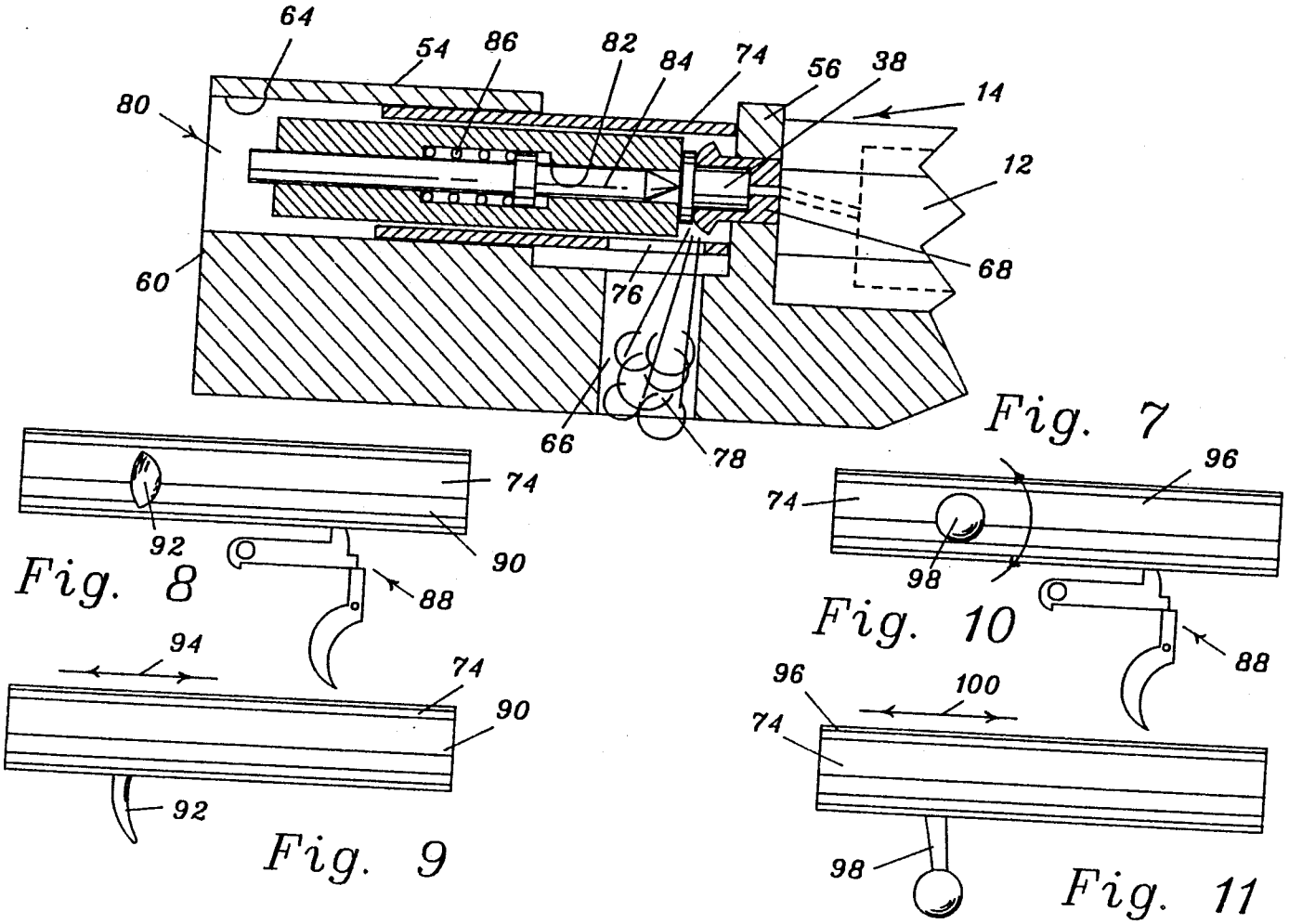
FIG. 7 is a simplified cutaway side view of the breech assembly of FIGS. 5 and 6 in the closed and firing position.
FIG. 8 is a simplified side view of a portion of the present invention with the trigger assembly connected thereto in an embodiment incorporating a slide bolt mechanism.
FIG. 9 is a top view of the apparatus of FIG. 8.
FIG. 10 is a simplified side view of a portion of the present invention with the trigger assembly connected thereto in an embodiment incorporating a rotating/slide bolt mechanism.
FIG. 11 is a top view of the apparatus of FIG. 10.

As shown in FIGS. 5–7, the breech assembly of the present invention is generally indicated as 52. Breech assembly 52 comprises a breech block member 54 adapted to be fitted into a gunstock, generally indicated as 55, and to receive the barrel 12 in combination with the gunstock. The breech block member 54 includes a first bulkhead 56 disposed over the breech end of the barrel 12. The first bulkhead 56 has a first bore 58 therein having an axis parallel to the axis of the barrel 12. The breach block member 54 further includes a second elongated bulkhead 60 spaced from the first bulkhead 56 to create a space 62 therebetween. The second bulkhead 60 has a second bore 64 therein in axial alignment with the first bore 58 and the breech block member 54 additionally includes a vertically disposed chimney bore 66 communicating between the bottom of the space 62 and the outside atmosphere.

A nipple member 68 is disposed in the first bore 58. The nipple member 68 has a third bore 70 therein having an axis parallel to the axis of the barrel 12 and facing into the space 62. The third bore 70 is sized to releasably receive a percussion cap 38 therein. The space 62 and nipple member 68 in combination allow easy finger access for the insertion and removal of percussion caps 38. The nipple member further has a fourth bore 72 therein communicating between the bottom of the third bore 70 and the interior of the barrel 12 at the breech end thereof whereby a percussion cap detonated in the third bore 70 will, in turn, detonate gunpowder disposed in the barrel 12.

A cylindrical sliding sleeve 74 is disposed within the second bore 64 and is slidable between a closed position against the first bulkhead 56 as shown in FIG. 5 to cover the space 62 and the nipple member 68 and a retracted position as shown in FIG. 6 spaced from the first bulkhead 56 to expose the space 62 and the nipple member 68. The sliding sleeve 74 has a slot 76 in the sidewalls thereof for the passage of blowback gases 78 therethrough from the nipple member 68 to the chimney bore 66 as shown in FIG. 7 when the sliding sleeve 74 is in the closed position shown therein.

A cylindrical firing pin assembly 80 is disposed within the sliding sleeve 74. The firing pin assembly 80 is slidable between a closed position close adjacent the nipple member 68 as shown in FIGS. 5 and 7 and a retracted position spaced from the nipple member 68 to expose the nipple member. The firing pin assembly 80 has an axial fifth bore 82 therethrough with a firing pin 84 slidably disposed within. A spring bias means 86 (such as the coil spring as indicated for simplicity) is disposed within the fifth bore 82 for urging the firing pin 84 towards the nipple member 68.

A trigger assembly, as generally indicated by the dotted line 88, of any type well known to those skilled in the art is operably connected for holding the firing pin 84 retracted from the nipple member 68 (and a percussion cap 38 contained therein) against the bias force of the spring bias means 86 as shown in FIG. 5 and for releasing the firing pin 84 to move towards the nipple member 68 and percussion cap 38 from the bias force of the spring bias means 86 to fire the muzzle loader as shown in FIG. 7.

Turning now to FIGS. 8–11, two bolt structures as well known in the art and employed by the applicant in modified form in tested embodiments of the present invention are shown. The first, as shown in FIGS. 8 and 9 is a slide bolt assembly, generally indicated as 90. Slide bolt assemblies generally of the type shown in FIGS. 8 and 9 are well known to those skilled in the art and, therefore, no detailed description thereof will be undertaken. As known, the slide bolt assembly 90 includes the sliding sleeve 74 with the firing pin assembly 80 disposed therein to move in combination therewith. To open the space 62 and cock the firing pin 84, the projection 92 is gripped and pulled backwards in the direction of the arrow 94. When the force on the projection 92 is released, the sliding sleeve 74 moves forward to the closed position under a self biasing force and the firing pin 84 is retained in its cocked position by the trigger assembly 88. The slide bolt assembly 90 includes a safety lever or button and other common features well known to those skilled in the art which form no part of the present invention per se and which are, therefore, not shown or indicated.

The second bolt assembly, as shown in FIGS. 10 and 11 is a rotating/slide bolt assembly, generally indicated as 96, of the type commonly known as a "bolt action". Bolt action assemblies and their manner of operation are also well known to those skilled in the art and therefore, again, no detailed description thereof will be undertaken. As known, the rotating slide bolt assembly 96 again includes the sliding sleeve 74 with the firing pin assembly 80 disposed therein to move in combination therewith. To open the space 62 and cock the firing pin 84, the bolt handle 98 is gripped, rotated counter clockwise to release the "bolt" and pulled backwards in the direction of the arrow 100. To close the "bolt", the bolt handle 98 is pushed forward moving the sliding sleeve 74 forward to the closed position and leaving the firing pin 84 retained in its cocked position by the trigger assembly 88. The bolt handle 98 is then rotated in the clockwise direction to lock the "bolt" in place. The rotating/slide bolt assembly 96 also includes a safety lever or button and other common features well known to those skilled in the art which form no part of the present invention per se and which are, therefore, again not shown or indicated in the interest of simplicity.

Figures 12, 13, 14:
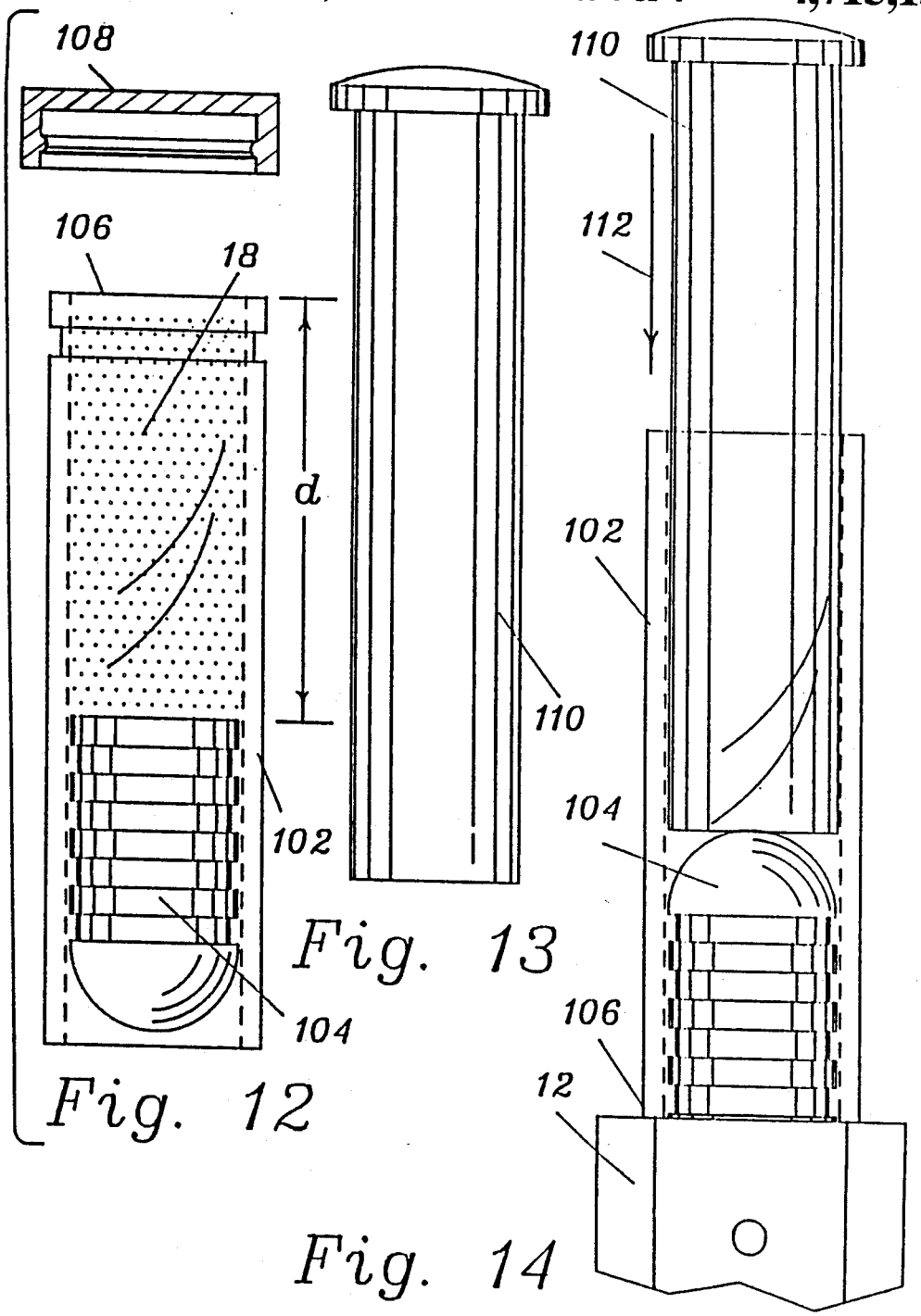
FIG. 12 is a side view of the body portion of the muzzle loader tool of the present invention showing how a bullet and powder charge are contained therein.
FIG. 13 is a side view of the plunger portion of the muzzle loader tool of the present invention.
FIG. 14 is a side view of the assembled muzzle loader tool of the present invention in the process of injecting its powder charge and bullet into the barrel of a muzzle loader.

Turning now to FIGS. 12–14, the muzzle loading tool which the applicant uses in combination with the foregoing closed breech assembly to accomplish the stated object of the present invention will now be described. The body portion 102 thereof is shown inverted in FIG. 12; that is, the bottom end is up as the figure is viewed. Body portion 102 is cylindricl in shape and open at both ends. It is of a resiliently deformable plastic such as polyethylene and of an outside diameter sized to snugly slide into the end of the barrel 12. The inside diameter is sized to snugly accept a bullet 104 therein. The distance "d" between the bottom of a bullet 104 disposed therein and the end 106 is selected so that a pre-established and desired measure of powder 18 will be contained therein. If desired, a snap-on plastic cap 108 can be provided therefor so that a number of preloaded charges can be conveniently carried. To load the muzzle loader with the tool, the end 106 is inserted into the end of the barrel 12 as shown in FIG. 14 and the cylindrical plastic plunger member 110 of FIG. 13, having an outside diameter adapted to slide within the body portion 102, is used to push the bullet 104 and the charge of powder 18 into the barrel 12 in the direction of arrow 112, following which a ramrod is used in the conventional manner to ram the charge home and insert the wadding.

Wherefore, having thus described my invention, I claim:

1. In a muzzle loader having a barrel with a breech end, an improved breech assembly comprising:

(a) a breech block member adapted to be fitted into a gunstock and to receive the barrel in combination with the gunstock, said breech block member including a first bulkhead disposed over the breech end of the barrel, said first bulkhead having a first bore therein having an axis parallel to the axis of the barrel, said breech block member further including a second bulkhead spaced from said first bulkhead to create a space therebetween, said second bulkhead having a second bore therein in axial alignment with said first bore, said breech block member additionally including a vertically disposed chimney bore communicating between the bottom of said space and the outside atmosphere;

(b) a nipple member disposed in said first bore, said nipple member having a third bore therein having an axis parallel to the axis of the barrel and facing into said space, said third bore being sized to releasably receive a percussion cap therein, said nipple member further having a fourth bore therein communicating between the bottom of said third bore and the interior of the barrel at the breech end thereof whereby a percussion cap detonated in said third bore will in turn detonate gunpowder disposed in the barrel;

(c) a cylindrical sliding sleeve disposed within said second bore, said sliding sleeve being slidable between a closed position against said first bulkhead to cover said space and said nipple member and a retracted position spaced from said first bulkhead to expose said space and said nipple member, said sliding sleeve having means in the sidewalls thereof for the passage of gases therethrough from said nipple member to said chimney bore when said sliding sleeve is in said closed position;

(d) a cylindrical firing pin assembly disposed within said sliding sleeve, said firing pin assembly being slidable between a closed position close adjacent said nipple member and a retracted position spaced from said nipple member to expose said nipple member, said firing pin assembly having an axial fifth bore therethrough and including a firing pin slidably disposed within said fifth bore and spring bias means for urging said firing pin towards said nipple member; and, (e) trigger means disposed in said breech block member for holding said firing pin retracted from said nipple member against the bias force of said spring bias means and for releasing said firing pin to move towards said nipple member from the bias force of said spring bias means.

2. The improved breech assembly for a muzzle loader of claim 1 wherein:

said cylindrical sliding sleeve and said cylindrical firing pin assembly are incorporated into a sliding bolt type rifle firing mechanism.

3. The improved breech assembly for a muzzle loader of claim 1 wherein:

said cylindrical sliding sleeve and said cylindrical firing pin assembly are incorporated into a bolt action type rifle firing mechanism.

4. In a muzzle loader having a barrel with a breech end, an improved breech assembly comprising:

(a) a breech block member adapted to be fitted into a gunstock and to receive the barrel in combination with the gunstock, said breech block member including a first bulkhead disposed over the breech end of the barrel, said first bulkhead having a first bore therein having an axis parallel to the axis of the barrel, said breech block member further including a second bulkhead spaced from said first bulkhead to create a space therebetween, said second bulkhead having a second bore therein in axial alignment with said first bore, said breech block member additionally including a vertically disposed chimney bore communicating between the bottom of said space and the outside atmosphere;

(b) a nipple member disposed in said first bore, said nipple member having a third bore therein having an axis parallel to the axis of the barrel and facing into said space, said third bore being sized to releasably receive a percussion cap therein, said nipple member further having a fourth bore therein communicating between the bottom of said third bore and the interior of the barrel at the breech end thereof whereby a percussion cap detonated in said third bore will in turn detonate gunpowder disposed in the barrel;

(c) a rifle bolt assembly disposed within said second bore, said rifle bolt assembly comprising an outer cylindrical sliding sleeve slidable between a closed position against said first bulkhead to cover said space and said nipple member and a retracted position spaced from said first bulkhead to expose said space and said nipple member and an inner cylindrical firing pin assembly disposed within said sliding sleeve and slidable between a closed position close adjacent said nipple member and a retracted position spaced from said nipple member to expose said nipple member, said firing pin assembly having a firing pin slidably disposed within and including spring bias means for urging said firing pin towards said nipple member and trigger means for holding said firing pin retracted from said nipple member against the bias force of said spring bias means and for releasing said firing pin to move towards said nipple member from the bias force of said spring bias means, said sliding sleeve having means in the sidewalls thereof for the passage of gases therethrough from said nipple member to said chimney bore when said sliding sleeve is in said closed position.

5. The improved breech assembly for a muzzle loader of claim 4 wherein:

said rifle bolt assembly is of the sliding bolt type.

6. The improved breech assembly for a muzzle loader of claim 4 wherein:

said rifle bolt assembly is of the bolt action type.

7. A closed breech assembly for a muzzle loader having a stock holding a barrel with a breech end, comprising:

(a) a breech block member adapted to be fitted into the gunstock and to receive the barrel in combination with the gunstock, said breech block member including a first bulkhead disposed over the breech end of the barrel, said first bulkhead having a first bore therein having an axis parallel to the axis of the barrel, said breech block member further including a second bulkhead spaced from said first bulkhead to create a space therebetween, said second bulkhead having a second bore therein in axial alignment with said first bore, said breech block member additionally including a vertically disposed chimney bore communicating between the bottom of said space and the outside atmosphere;

(b) a nipple member disposed in said first bore, said nipple member having a third bore therein having an axis parallel to the axis of the barrel and facing into said space, said third bore being sized to releasably receive a percussion cap therein, said nipple member further having a fourth bore therein communicating between the bottom of said third bore and the interior of the barrel at the breech end thereof whereby a percussion cap detonated in said third bore will in turn detonate gunpowder disposed in the barrel;

(c) a rifle bolt assembly of the sliding bolt type disposed within said second bore, said rifle bolt assembly comprising an outer cylindrical sliding sleeve slidable between a closed position against said first bulkhead to cover said space and said nipple member and a retracted position spaced from said first bulkhead to expose said space and said nipple member and an inner cylindrical firing pin assembly disposed within said sliding sleeve and slidable between a closed position close adjacent said nipple member and a retracted position spaced from said nipple member to expose said nipple member, said firing pin assembly having a firing pin slidably disposed within and including spring bias means for urging said firing pin towards said nipple member and trigger means for holding said firing pin retracted from said nipple member against the bias force of said spring bias means and for releasing said firing pin to move towards said nipple member from the bias force of said spring bias means, said sliding sleeve having means in the sidewalls thereof for the passage of gases therethrough from said nipple member to said chimney bore when said sliding sleeve is in said closed position.

8. A closed breech assembly for a muzzle loader having a stock holding a barrel with a breech end, comprising:

(a) a breech block member adapted to be fitted into the gunstock and to receive the barrel in combination with the gunstock, said breech block member including a first bulkhead disposed over the breech end of the barrel, said first bulkhead having a first bore therein having an axis parallel to the axis of the barrel, said breech block member further including a second bulkhead spaced from said first bulkhead to create a space therebetween, said second bulkhead having a second bore therein in axial alignment with said first bore, said breech block member additionally including a vertically disposed chimney bore communicating between the bottom of said space and the outside atmosphere;

(b) a nipple member disposed in said first bore, said nipple member having a third bore therein having an axis parallel to the axis of the barrel and facing into said space, said third bore being sized to releasably receive a percussion cap therein, said nipple member further having a fourth bore therein communicating between the bottom of said third bore and the interior of the barrel at the breech end thereof whereby a percussion cap detonated in said third bore will in turn detonate gunpowder disposed in the barrel;

(c) a rifle bolt assembly of the bolt action type disposed within said second bore, said rifle bolt assembly comprising an outer cylindrical sliding sleeve slidable between a closed position against said first bulkhead to cover said space and said nipple member and a retracted position spaced from said first bulkhead to expose said space and said nipple member and an inner cylindrical firing pin assembly disposed within said sliding sleeve and slidable between a closed position close adjacent said nipple member and a retracted position spaced from said nipple member to expose said nipple member, said firing pin assembly having a firing pin slidably disposed within and including spring bias means for urging said firing pin towards said nipple member and trigger means for holding said firing pin retracted from said nipple member against the bias force of said spring bias means and for releasing said firing pin to move towards said nipple member from the bias force of said spring bias means, said sliding sleeve having means in the sidewalls thereof for the passage of gases therethrough from said nipple member to said chimney bore. when said sliding sleeve is in said closed position.

* * * * *